United States Patent [19]

Kamada et al.

[11] 4,331,447

[45] May 25, 1982

[54] COAL TREATMENT FOR ASH REMOVAL AND AGGLOMERATION

[75] Inventors: Hiroshi Kamada, Ebina; Kazumoto Saito, Fujimi; Toshiaki Murata, Toda; Tadahisa Miwa, Ohmiya; Masao Goto, Ohmihachiman; Toshiro Fukuda, Ohtsu; Hitoshi Taguchi, Kyoto, all of Japan

[73] Assignees: Sanyo Chemical Industries, Ltd., Kyoto; The Coal Mining Research Centre, Tokyo, both of Japan

[21] Appl. No.: 169,807

[22] Filed: Jul. 17, 1980

[30] Foreign Application Priority Data

| | | | |
|---|---|---|---|
| Mar. 4, 1980 | [JP] | Japan | 55/27725 |
| Mar. 5, 1980 | [JP] | Japan | 55/28449 |
| Mar. 5, 1980 | [JP] | Japan | 55/28450 |
| Mar. 5, 1980 | [JP] | Japan | 55/28451 |
| Mar. 5, 1980 | [JP] | Japan | 55/28452 |
| Mar. 5, 1980 | [JP] | Japan | 55/28453 |
| Mar. 6, 1980 | [JP] | Japan | 55/28948 |

[51] Int. Cl.[3] ..... C10L 5/14

[52] U.S. Cl. ..... 44/20; 44/6; 44/24

[58] Field of Search ..... 44/1 R, 1 SR, 6, 24, 44/20, 23

[56] References Cited

U.S. PATENT DOCUMENTS

| | | | |
|---|---|---|---|
| 3,988,120 | 10/1976 | Chia | 44/1 SR |
| 4,076,505 | 2/1978 | Dessau | 44/1 SR |
| 4,153,419 | 5/1979 | Clayfield et al. | 44/23 |
| 4,209,301 | 6/1980 | Nicol et al. | 44/24 |
| 4,217,109 | 8/1980 | Siwersson et al. | 44/1 SR |

*Primary Examiner*—Carl F. Dees

*Attorney, Agent, or Firm*—Oblon, Fisher, Spivak, McClelland & Maier

[57] ABSTRACT

Coal particles can be agglomerated with simultaneous ash removal therefrom by adding an oil fraction to an aqueous slurry of coal particles which contains a surfactant and optionally an inorganic electrolyte.

27 Claims, No Drawings

COAL TREATMENT FOR ASH REMOVAL AND AGGLOMERATION

BACKGROUND OF THE INVENTION

1. Field of the Invention

This invention relates to a process for agglomerating coal particles and simultaneously removing ashes therefrom. More particularly, it relates to such process comprising adding an oil fraction to an aqueous slurry of coal particles or coal fines.

2. Description of the Prior Art

In view of the recent increase in the price of petroleum fuel oils as well as the limited amount of crude oil reserves, much attention is now focused on coal, which is now less expensive and exists in large quantities all over the world. However, one drawback is that coal is rich in substances inert to reactions (including combustion) or rather detrimental to the same, such as inorganic materials (also called ash) including clays, and moisture. Preliminary removal of the ash and moisture in coal dressing plants will bring advantages such as reduction in coal transportation costs, simplification of combustion furnaces, smoke-eliminating apparatuses and the like in thermoelectric power stations, for instance, and fewer problems caused by ash treatment. Therefore, techniques of the so-called coal cleaning, which includes ash removal, desulfurization (with respect to inorganic sulfur) and dehydration are now under active development. Thus, for example, a process has been studied which comprises adding an oil fraction as a binder to a coal slurry to cause agglomeration of coal particles and thereby recover coal agglomerates separately from ash, inorganic sulfur, water and other impurities. However, a study of this process for coal agglomeration in water has revealed a number of problems. For example, the amount of the oil fraction as a binder in agglomeration is too large; the energy consumption in the agglomeration, which can be expressed by the formula $n^3t$ where n is the number of revolutions per unit time in agitation and t is the agglomeration time, is too large; the process is too expensive from a commercial viewpoint; and ash cannot be removed to a satisfactory extent. Thus, the process cannot be a satisfactory coal cleaning process.

Another process has been proposed, which comprises adding an aqueous emulsion of an oil fraction to an aqueous slurry of coal fines and agitating the mixture to form agglomerates of coal particles. However, this process has a problem of reduced producitivity because preliminary preparation of the aqueous emulsion of an oil fraction is necessary and because it is required to repeat the treatment at least two times.

SUMMARY OF THE INVENTION

Accordingly, it is one object of this invention to provide a process for treating coal for ash removal and agglomeration, by which the ash removal and agglomeration can be achieved to a satisfactory extent at reduced costs.

It is another object of this invention to provide a process for the treatment of coal for ash removal and agglomeration, in which the productivity can be improved.

Briefly, these and other objects of the invention as hereinafter will become more readily apparent have been attained broadly by providing a process for the treatment of coal particles for ash removal and agglomeration thereof, which comprises adding an oil fraction as a binder to an aqueous slurry of coal particles which contains a surfactant with or without an inorganic electrolyte, followed by agitating the mixture to cause the desired ash removal and agglomeration of coal particles.

DETAILED DESCRIPTION OF THE PREFERRED EMBODIMENTS

The surfactant to be used in accordance with the invention includes conventional surfactants such as nonionic, anionic, cationic and amphoteric ones. More specifically, the following surfactants are used.

[N] NONIONIC SURFACTANTS

(N-1) Alkylolamide type surfactants

There may be mentioned alkylolamide type surfactants represented by the general formula

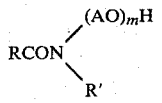

(1)

wherein R is an acyl group residue containing 5 to 24 carbon atoms, A is an alkylene group containing 2 to 4 carbon atoms, R′ is $(—AO)_nH$ or a hydrocarbon group, m is an integer of at least 1, n is 0 (zero) or an integer of at least 1, and m+n is equal to 1 to 100.

In formula (1), R is an acyl group residue [acyl minus —CO— (carbonyl)] of 5 to 24 carbon atoms, preferably 9 to 20 carbon atoms, and may thus be an aliphatic, alicyclic or aromatic hydrocarbon group. The aliphatic hydrocarbon group includes, for example, alkyl groups of 5 to 24 carbon atoms such as pentyl, 1-ethylpentyl, octyl, nonyl, undecyl (lauroyl group residue), tridecyl, pentadecyl, hexadecyl, heptadecyl (stearoyl group residue) and eicosyl, $C_{5-24}$ alkenyl groups such as oleyl (oleoyl group residue), and further linoleyl and linolenyl. The alicyclic hydrocarbon group is, for example, cyclohexyl, and the aromatic hydrocarbon group includes aryl groups such as phenyl and naphthyl, aryl-substituted groups such as aralkyl groups (e.g. benzyl, phenetyl) and aralkenyl groups (e.g. cinnamyl), and substituted aryl groups such as alkaryl groups (e.g. aryl groups substituted by an alkyl group of 1 to 24 carbon atoms, such as tolyl and nonylphenyl). The acyl group residue may also contain a substituent such as —OH. Thus, for example, it may be a hydroxyl-substituted aliphatic hydrocarbon group such as a hydroxyl-substituted alkenyl group (e.g. ricinoleyl) or a hydroxyl-substituted aromatic hydrocarbon group such as a hydroxyl-substituted aryl group (e.g. salicyl). Preferred R groups are alkyl, alkenyl and OH-substituted alkenyl groups each containing 9 to 20 carbon atoms, and especially preferred groups are undecyl, heptadecyl and oleyl.

A is an alkylene group of 2 to 4 carbon atoms, such as ethylene, propylene or butylene. Ethylene is a preferred example of A. R′ is $(—AO)_nH$ or a hydrocarbon group. An example of the hydrocarbon group is cyclohexyl. Among the R′ groups, preferred are $(—AO)_nH$ groups.

m+n is equal to 1 to 100, preferably 1 to 20, and more preferably 1 to 5. When m+n is in the above range, effective ash removal and agglomeration can be achieved.

Examples of the compound represented by general formula (1) are reaction products of fatty acids generally containing 6 to 25 carbon atoms and alkanolamines, and alkylene oxide ($C_2$–$C_4$) adducts of such reaction products. The fatty acids of 6 to 25 carbon atoms are saturated fatty acids such as lauric, palmitic and stearic acids, unsaturated fatty acids such as oleic, linoleic and linolenic acids, mixed fatty acids such as palm oil or coconut oil fatty acid, and hydroxy fatty acids such as ricinoleic acid. Preferred are fatty acids of 10 to 20 carbon atoms. More preferred are lauric, stearic, oleic and palm or coconut oil fatty acids. Examples of the alkanolamines are mono- and di-ethanolamines, isopropanolamines and cyclohexylethanolamine, and preferred alkanolamines are ethanolamines, especially diethanolamine. The molar ratio of the acid to the amine is generally 1:1 to 1:3, preferably 1:1 to 1:2. Typical examples of the compound of formula (1) are lauric acid mono- and di-ethanolamides (1:1–2), stearic acid mono- and di-ethanolamides (1:1–2), coconut oil fatty acid mono- and di-ethanolamides (1:1–2), coconut oil fatty acid cyclohexylethanolamide (1:3), linolenic acid diethanolamide (1:2), ricinoleic acid diethanolamide (1:2) and mixtures of these, as well as alkylene oxide ($C_2$–$C_4$) adducts derived from these.

Preferred among the alkylolamide type surfactants are lauric, stearic, oleic, and palm oil or coconut oil fatty acid mono- or diethanolamide.

(N-2) Polyoxyalkylene type nonionic surfactants (other than those belonging to (N-1))

(1) Polyoxyalkylene polyhydric alcohol fatty acid esters

AO adducts derived from esters of polyhydric alcohols having 3–8 hydroxyl groups or intramolecular anhydrides thereof (e.g. glycerol, trimethylolpropane, pentaerythritol, sorbitan, sorbitol and sucrose) with fatty acids generally containing 10 to 20 carbon atoms, the number of moles of AO being generally 2 to 50, preferably 10 to 40, such as sorbitan monolaurate-EO(10), sorbitan monooleate-EO(20)/PO(10), sorbitan monostearate-EO(30), sorbitan trioleate-EO(23), oleic acid monoglyceride-PO(10) and soybean oil fatty acid monopentaerythritol ester-PO(3). (The sorbitan monooleate-EO(20)/PO(10) is a product obtained by adding 20 moles of EO and 10 moles of PO randomly to sorbitan monooleate.) In the above and hereinafter, AO stands for alkylene oxide, EO for ethylene oxide and PO for propylene oxide. The numerical value in parenthesis stands for the number of moles.

(2) Polyoxyalkylene fatty acid esters

Esters of polyalkylene glycol with fatty acids generally containing 10 to 20 carbon atoms, as well as AO adducts thereof, the number of moles of AO added being generally 2 to 50, preferably 2 to 20, such as mono- and di-oleate esters of polyethylene glycol having an average molecular weight of 600, and stearic acid-EO(4).

(3) Polyoxyalkylene alkylamines

AO adducts of alkylamines generally containing 10 to 20 carbon atoms, the number of moles of AO added being generally 2 to 50, preferably 2 to 20 such as stearylamine-EO(3).

(4) Polyoxyalkylene alkylaryl ethers

AO adducts from alkylphenols or alkylnaphthols which contain each at least one alkyl group generally containing 8 to 12 carbon atoms, the number of moles of AO added being generally 2 to 50, preferably 2 to 20, such as octylphenol-PO(10), dodecylphenol-EO(10) and dinonylphenol-EO(16).

(5) Polyoxyethylene polyoxypropylene polyols (5)-1 Pluronic type nonionic surfactants, such as EO adducts of polypropylene glycol (hereinafter, PPG) with average molecular weights ($\overline{MW}$) of 900 to 2,900, the EO content in the molecule being generally 10 to 80 weight %, preferably 40 to 80 weight %, for example, PPG ($\overline{MW}$: 1,200)-EO(40 weight %) adduct, PPG($\overline{MW}$: 1,750)-EO(50 weight %) adduct and PPG($\overline{MW}$: 2,050)-EO(80 weight %) adduct.

(5)-2 Tetronic type nonionic surfactants, such as polyoxypropylene-alkylenediamine-EO adducts with average molecular weights ($\overline{MW}$) of 1,000 to 30,000, the EO content in the molecule being generally 10 to 80 weight %. (e.g. Tetronic 304, 704 and 707 (Wyandotte Chemicals)).

(6) Polyoxyalkylene alkyl ethers

Aliphatic alcohol-AO adducts, the aliphatic alcohol being a natural or synthetic, straight or branched chain alcohol containing generally 6 to 20 carbon atoms, preferably 12 to 18 carbon atoms, the number of moles of AO added being generally 2 to 50, preferably 2 to 20, such as octyl alcohol-EO(10), decyl alcohol-PO(5), hydrogenated coconut oil alcohol-EO(5), synthetic $C_{11}$, $C_{13}$ and $C_{15}$ alcohol mixture-EO(5)-PO(11) and oleyl alcohol-EO(12). (The synthetic $C_{11}$, $C_{13}$ and $C_{15}$ alcohol mixture-EO(5)-PO(11) contains 5 moles of EO and 11 moles of PO added in this order.)

(7) Polyoxyalkylene styrenated aryl ethers

AO adducts derived from products of reaction of 1 to 20 moles of styrene, with monocyclic phenols (e.g. phenol, alkylphenols having at least one alkyl group of 1 to 12 carbon atoms) or polycyclic phenols (e.g. phenols containing two or more aromatic rings, such as phenylphenols and cumylphenol; and alkyl ($C_1$–$C_{12}$) naphthols), the number of moles of AO added being generally 2 to 50, preferably 10 to 40, such as styrenated (2) phenol-EO(10) and styrenated (4) phenol-EO(15)-PO(10). (The styrenated (2) phenol-EO(10) is a product of addition of 10 moles of EO to styrenated phenol, which in turn is a product of reaction of phenol and styrene in a molar ratio of 1:2.)

(8) Polyoxyalkylene mercaptans

AO adducts of alkyl mercaptans generally containing 10 to 20 carbon atoms, the number of moles of AO added being generally 2 to 50, preferable 2 to 20 such as cetyl mercaptan-EO(5).

Preferred among the polyoxyalkylene type nonionic surfactants [other than those belonging to (N-1)] mentioned under (N-2) are polyoxyalkylene polyhydric alcohol fatty esters, polyoxyalkylene fatty acid esters, polyoxyalkylene alkylamines and mixtures thereof.

(N-3) Polyhydric alcohol type nonionic surfactants (1) Polyhydric alcohol fatty acid esters Esters of polyhydric alcohols having 2–8 hydroxyl groups or intramolecular anhydrides thereof such as mentioned above with fatty acids generally containing 10 to 20 carbon atoms, such as lauric acid monoglyceride, sorbitan mono-, sesqui- and tri-stearates, sorbitan mono-, sesqui- and tri-oleates and sucrose mono- and di-stearates.

[A] ANIONIC SURFACTANTS (A-1) Sulfate ester salts (1) Alkyl sulfate ester salts There may be mentioned salts of sulfate esters of straight and/or branched chain, saturated and/or unsaturated alcohols generally containing 6 to 20 carbon atoms, preferably 12 to 18 carbon atoms.

The alcohols include natural alcohols such as decyl, lauryl, myristyl, cetyl, stearyl, oleyl, sperm oil, hydrogenated tallow oil and hydrogenated coconut oil alcohols and mixtures thereof, synthetic alcohols such as Ziegler alcohols, oxo alcohols [those with side chain alcohol contents of 20 to 70 weight %, such as "Dobanol" (Shell Chemical) and "Diadol" (Mitsubishi Chemical Industries)] and secondary alcohols, and mixtures thereof.

The salts include, among others, alkali metal salts (e.g. sodium and potassium salts), ammonium salts and amine salts (e.g. salts with alkanol ($C_2$–$C_4$) amines such as mono-, di- and tri-ethanolamines and propanolamines).

Typical examples are sodium salt of decyl alcohol sulfate, sodium salt of lauryl alcohol sulfate, ammonium salt of cetyl alcohol sulfate and ammonium salt of $C_{11}$–$C_{17}$ oxo alcohol sulfate, the oxo alcohol having a side chain content of 50% or more.

(2) Polyoxyalkylene alkyl sulfate ester salts

There may be mentioned sulfate ester salts derived from AO adducts of straight and/or branched chain, saturated and/or unsaturated alcohols containing generally 6 to 20 carbon atoms, preferably 12 to 18 carbon atoms, and secondary alcohols [e.g. "Tergitol S" (Union Carbide Corporation)], the number of moles of AO added being generally 2 to 50, preferably 2 to 20.

The alcohols and salts may be the same as those mentioned under (A-1), (1).

Typical examples are ammonium salt of decyl alcohol-EO(1) sulfate, sodium salt of lauryl alcohol-EO(4) sulfate, triethanolamine salt of cetyl alcohol-EO(8) and ammonium salt of Tergitol 15-S-9 sulfate (Tergitol 15-S-9 being UCC's secondary alcohol-EO adduct).

(3) Polyoxyalkylene alkylaryl ether sulfate salts

Sulfate ester salts derived from EO adducts of alkylphenols or alkylnaphthols having at least one alkyl group generally containing 8 to 12 carbon atoms, the number of moles of EO added being generally 2 to 50, preferably 2 to 20, such as sodium salt of nonylphenol-EO(4) sulfate.

(4) Sulfate ester salts derived from higher fatty acid esters

Sulfate ester salts derived from saturated and/or unsaturated fatty acid monoglycerides, the fatty acid moiety generally containing 10 to 20 carbon atoms, such as sodium salt of coconut oil fatty acid monoglyceride sulfate.

(5) Higher fatty acid alkylolamide sulfate ester salts

Sulfate ester salts derived from saturated and/or unsaturated fatty acid alkylol ($C_2$–$C_4$) amides, the fatty acid moiety generally containing 10 to 20 carbon atoms, such as sodium salt of coconut oil fatty acid monoethanolamide sulfate.

(6) Sulfated oils, highly sulfated oils, sulfated fatty acid esters and sulfated fatty acids ($C_{10}$–$C_{20}$).

Turkey red oil, sodium salt of sulfated butyl oleate, sodium salt of sulfated oleic acid, and the like.

(7) Sulfated olefins

Sodium salts of sulfated alpha-olefins generally containing 12 to 18 carbon atoms.

(A-2) Carboxylic acid salts (1) Salts of saturated or unsaturated fatty acids or of hydroxyl- containing fatty acids, generally containing 6 to 20 carbon atoms, preferably 12 to 18 carbon atoms The above-mentioned fatty acids include lauric, stearic, oleic and ricinoleic acids, coconut oil, tallow and castor oil fatty acids, synthetic fatty acids, and mixtures of these.

The salts include alkali metal salts (e.g. sodium and potassium salts), ammonium salts and amine salts (e.g. alkanol ($C_2$–$C_4$) amine salts).

Typical examples are sodium salts of lauric, stearic and oleic acids.

(A-3) Sulfonic acid salts (1) Alkylbenzenesulfonic acid salts

There may be mentioned alkylbenzenesulfonic acid salts having at least one straight or branched alkyl group generally containing 8 to 20 carbon atoms, preferably 10 to 18 carbon atoms.

The salts are the same as those mentioned under (A-2), (1). Alkaline earth metal salts (e.g. calcium and magnesium salts) may also be used.

Sodium dodecylbenzenesulfonate is a typical example.

(2) Salts of sulfosuccinate esters

There may be mentioned dialkyl sulfosuccinate salts, the alkyl groups each containing generally 6 to 20 carbon atoms. The alkyl group may be a cycloalkyl.

The salts are the same as those mentioned under (A-3), (1).

Typical examples are sodium salt of di-2-ethylhexyl sulfosuccinate and sodium salt of dicyclohexyl sulfosuccinate.

(3) (Alkyl)naphthalenesulfonic acid salts and condensation products from (alkyl)naphthalenesulfonic acid salts and formaldehyde There may be mentioned salts of naphthalenesulfonic acid and of alkylnaphthalenesulfonic acids each having at least one alkyl group containing generally 1 to 18 carbon atoms as well as condensation products of these with formaldehyde, a degree of condensation being generally 1.2 to 30, preferably 2.0 to 10. The salts are the same as those mentioned under (A-3), (1).

A typical example is sodium salt of diisopropylnaphthalenesulfonic acid.

(4) Alkanesulfonic acid salts

E.g. salts of alkanesulfonic acids having alkyl groups containing generally 8 to 20 carbon atoms, such as sodium tetradecylsulfonate.

(5) Alpha-olefinsulfonic acid salts

E.g. sodium salts of alpha-olefinsulfonic acid generally containing 15 to 18 carbon atoms.

(6) Salts of fatty acid ($C_{10}$–$C_{20}$) amide sulfonic acids

E.g. Igepon T (General Anilin & Film).

(7) Lignisulfonic acid salts (e.g. sodium salts), petroleum sulfonic acid salts (e.g. sodium salts), etc.

(A-4) Phosphate ester salts (1) Alkyl phosphate ester salts

There may be mentioned salts of phosphoric acid mono- and/or di-esters of saturated or unsaturated alcohols generally containing 6 to 20 carbon atoms, preferably 12 to 18 carbon atoms.

The above-mentioned alcohols include 2-ethylhexyl, lauryl, stearyl and oleyl alcohols as well as hydrogenated sperm oil alcohol and hydrogenated coconut oil alcohol.

The salts are the same as those mentioned under (A-2).

A typical example is disodium salt of monostearyl phosphate.

(2) Polyoxyalkylene alkyl ether phosphate ester salts

There may be mentioned salts of acid phosphate esters of adducts of EO with saturated or unsaturated alcohols generally containing 6 to 20 carbon atoms, the number of moles AO added being generally 2 to 50, preferably 2 to 20 such as monosodium salt of phosphoric acid diester of stearyl alcohol-EO(10).

(3) Polyxyalkylene alkylaryl ether phosphate ester salts

There may be mentioned salts of acid phosphate esters of adducts of EO and alkylphenols or alkylnaphthols having at least one alkyl group generally containing 8 to 12 carbon atoms, such as monosodium salt of phosphoric acid diester of nonylphenol-EO(5). Preferred among these anionic surfactants mentioned under [A] are sulfate ester salts mentioned under (A-1). More preferred are alkyl sulfate ester salts, polyoxyalkylene alkyl sulfate ester salts and polyoxyalkylene alkylaryl sulfate salts.

[C] CATIONIC SURFACTANTS

(C-1) Quaternary ammonium salt type cationic surfactants (1-1) Quaternary ammonium salts derived from aliphatic amines There may be mentioned compounds represented by the general formula

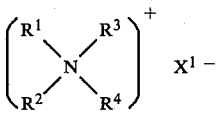

(2)

wherein $R^1$ is an alkyl group having 10 to 20 carbon atoms or an alkylamidoalkyl group, $R^2$ is an alkyl group of 1 to 3 carbon atoms, a hydroxyalkyl group of 2 to 4 carbon atoms, an alkyl group of 10 to 20 carbon atoms or an alkylamidoalkyl group, $R^3$ is an alkyl group of 1 to 3 carbon atoms or a hydroxyalkyl group of 2 to 4 carbon atoms, $R^4$ is an alkyl group of 1 to 3 carbon atoms, a hydroxyalkyl group of 2 to 4 carbon atoms or benzyl group, and $X^1$ is an anionic counter ion.

In general formula (2), the alkyl group of 10 to 20 carbon atoms includes saturated and unsaturated groups such as decyl dodecyl, tridecyl, tetradecyl, octadecyl, eicosyl and oleyl. The alkylamidoalkyl group includes alkylamidoalkyl groups derived from fatty acids containing 10 to 20 carbon atoms and aminoalkyl groups having $C_2$-$C_4$, such as $C_{17}H_{33}CONHCH_2CH_2$— and $C_{17}H_{35}CONHCH_2CH_2CH_2$—. The hydroxyalkyl group of 2 to 4 carbon atoms is, for example, —$CH_2CH_2OH$ or —$CH_2CH(CH_3)CH_2OH$. The anionic counter ion $X^1-$ includes halide ions such as $Cl^-$, $Br^-$ and $I^-$, and further $CH_3OSO_3^-$, $C_2H_5OSO_3^-$, $HSO_4^-$ and $NO_3^-$. Preferred are halide ions.

The quaternary ammonium salts of general formula (2) include the following.

(1) Monoalkyltrimethylammonium salts

Monoalkyltrimethylammonium salts having a straight or branched alkyl group containing 10 to 20 carbon atoms, such as decyltrimethylammonium chloride, tetradecyltrimethylammonium bromide, hexadecyltrimethylammonium chloride, octadecyltrimethylammonium chloride and octadecyltrimethylammonium methosulfate.

(2) Dialkyldimethylammonium salts

Dialkyldimethylammonium salts having two straight or branched $C_{10}$–$C_{20}$ alkyl groups, such as didodecyldimethylammonium chloride, dihexadecyldimethylammonium bromide and dodecyloctadecyldimethylammonium iodide.

(3) Monoalkyldimethylbenzylammonium salts

Monoalkyldimethylbenzylammonium salts having one straight or branched $C_{10}$ to $C_{20}$ alkyl group, such as dodecyldimethylbenzylammonium bromide, hexadecyldimethylbenzylammonium chloride, octadecyldimethylbenzylammonium chloride and octadecyldimethylbenzylammonium ethosulfate.

(4) Dialkylmethylbenzylammonium salts

Dialkylmethylbenzylammonium salts having two alkyl groups, each alkyl group being straight or branched and containing 10 to 20 carbon atoms, such as didodecylmethylbenzylammonium chloride, tetradecyloctadecylmethylbenzylammonium bromide and dioctadecylmethylbenzylammonium chloride.

(5) Quaternary ammonium salts having a $C_2$ or $C_3$ alkyl group, an amido group and/or a $C_2$ to $C_4$ hydroxyalkyl group.

E.g. monoalkyldimethylethylammonium bromide, monoalkyldimethylpropylammonium chloride, dialkylmethylethylammonium methosulfate, dialkylmethylpropylammonium chloride, oleamidoethyl diethylmethylammonium methosulfate, stearamidoethyl diethylbenzylammonium chloride, stearamidopropyl dimethylhydroxyethylammonium nitrate.

Those compound mentioned under (1), (2) and (3) are preferred quaternary ammonium salts.

(1-2) Quaternay ammonium salts derived from cyclic amines (e.g. pryridine, morpholine)

(1) Alkyloyloxymethylpyridinium salts, the alkyloyl moiety having generally 8 to 24 carbon atoms, preferably 12 to 18 carbon atoms.

The salts are those with anionic counter ions such as halide ions (e.g. $Cl^-$, $Br^-$, $I^-$), $CH_3OSO_3^-$, $C_2H_5OSO_3^-$, $HSO_4^-$ and $NO_3^-$.

Preferred are halide ion salts and $HSO_4^-$ salts.

Stearoyloxymethylpyridinium chloride is a typical example.

(2) Alkyloxymethylpyridinium salts, the alkyl moiety having generally 8 to 24 carbon atoms, preferably 12 to 18 carbon atoms.

The anionic counter ions are the same as those mentioned under (1-2), (1) above. A typical example is hexadecyloxymethylpyridinium chloride.

(3) Alkylpyridinium salts having an alkyl group of generally 8 to 24 carbon atoms, preferably 12 to 18 carbon atoms.

The anionic counter ions are the same as those mentioned under (1-2) (1) above.

A typical example is tetradecylpyridinium sulfate.

(4) Alkylquinolinium salts having an alkyl group of generally 8 to 24 carbon atoms, preferably 12 to 18 carbon atoms.

The anionic counter ions are the same as those mentioned under (1-2) (1) above.

A typical example is tetradecylquinolinium chloride.

(C-2) Amine salt type cationic surfactants

There may be mentioned compounds represented by the general formula

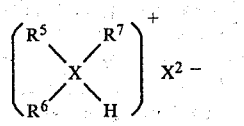

(3)

wherein $R^5$ is an alkyl group of 10 to 20 carbon atoms or an amidoalkyl group, $R^6$ is H, an alkyl group of 1 to 3 carbon atoms, a hydroxyalkyl group of 2 to 4 carbon atoms, an alkyl group of 10 to 20 carbon atoms or an alkylamidoalkyl group, $R^7$ is H, an alkyl group of 1 to 3 carbon atoms or a hydroxyalkyl group of 2 to 4 carbon atoms or benzyl group and $X^{2-}$ is an anionic counter ion.

In general formula (3), the $C_{10}$ to $C_{20}$ alkyl group, the alkylamidoalkyl group, the $C_2$ to $C_4$ hydroxyalkyl group and $X^{2-}$ are the same as those mentioned for general formula (2).

The amine salt type cationic surfactants of general formula (3) include the following compounds.

(1) Monoalkyldimethylamine salts

Monoalkyldimethylamine salts, the alkyl moiety being a straight or branched, $C_{10}$–$C_{20}$ alkyl group, such as dodecyldimethylamine hydrochloride, tetradecyldimethylamine hydrobromide, hexadecyldimethylamine hydrochloride and octadecyldimethylamine hydrochloride.

(2) Dialkylmonomethylamine salts

Dialkylmonomethylamine salts, each of the two alkyl moieties being a straight or branched, $C_{10}$ to $C_{20}$ alkyl group, such as didodecylmonomethylamine hydrochloride, dihexadecylmonomethylamine hydrobromide and dodecyloctadecylmonomethylamine hydroiodide.

(3) Monoalkylmonomethylbenzylamine salts

Monoalkylmonomethylbenzylamine salts having a straight or branched, $C_{10}$ to $C_{20}$ alkyl group, such as dodecylmonomethylbenzylamine hydrobromide, hexadecylmonomethylbenzylamine hydrochloride and octadecylmonomethylbenzylamine hydrochloride.

(4) Monoalkylmonomethylamine salts

Monoalkylmonomethylamine salts having a straight or branched, $C_{10}$ to $C_{20}$ alkyl group, such as dodecylmonomethylamine hydrochloride, tetradecylmonomethylamine hydrobromide and hexadecylmonomethylamine hydrochloride.

(5) Monoalkylbenzylamine salts

Monoalkylbenzylamine salts having a straight or branched, $C_{10}$ to $C_{20}$ alkyl group, such as dodecylbenzylamine hydrobromide and hexadecylbenzylamine hydrobromide.

(6) Monoalkylamine salts

E.g. dodecylamine hydrochloride, aminoethyl stearate hydrochloride.

Preferred among these cationic surfactants mentioned under [C] are quaternary ammoinium salt type cationic surfactants mentioned under (C-1) and amine salt type cationic surfactants mentioned under (C-2), more preferably those mentioned under (C-1), (1-1).

[AM] AMPHOTERIC SURFACTANTS (AM-1) Carboxylate salt type amphoteric surfactants (1) Amino acid type (1-1) Alanine type (a) N-Alkyl-beta-aminopropionic acid salts, the alkyl moiety containing generally 8 to 24 carbon atoms, preferably 12 to 18 carbon atoms.

E.g. sodium N-octadecyl-beta-aminopropionate.

(b) N-Alkyl-beta-iminodipropionic acid salts, the alkyl moiety containing generally 8 to 24 carbon atoms, preferably 12 to 18 carbon atoms.

E.g. sodium N-dodecyl-beta-iminodipropionate.

(1-2) Glycine type (a) Alkyldi(aminoethyl)glycine salts, the alkyl moiety containing generally 8 to 24 carbon atoms, preferably 12 to 18 carbon atoms.

E.g. tetradecyldi(aminoethyl)glycine hydrochloride.

(b) Dialkyldiethylenetriamineacetic acid salts, the alkyl moieties each containing generally 8 to 24 carbon atoms, preferably 12 to 18 carbon atoms.

E.g. dioctyldiethylenetriamineacetic acid hydrochloride.

(2) Betaine type (2-1) Carboxy betaine type (a) N-Alkyltriglycines, the alkyl moiety containing generally 8 to 24 carbon atoms, preferably 12 to 18 carbon atoms.

E.g. N-dodecyltriglycine, N-tetradecyltriglycine, N-hexadecyltriglycine, N-octadecyltriglycine.

(b) Dimethylalkylbetaines, the alkyl moiety containing generally 8 to 24 carbon atoms, preferably 12 to 18 carbon atoms.

E.g. dimethylundecylbetaine, dimethyltridecylbetaine, dimethylpentadecylbetaine, dimethylheptadecylbetaine.

(c) N-alkyloxymethyl-N, N-diethylbetaines, the alkyl moiety containing generally 8 to 24 carbon atoms, preferably 12 to 18 carbon atoms.

E.g. N-dodecyloxymethyl-N, N-diethylbetaine, N-tridecyloxymethyl-N, N-diethylbetaine, N-pentadecyloxymethyl-N, N-diethylbetaine.

(d) Alkylbetaines, the alkyl moiety containing generally 8 to 24 carbon atoms, preferably 12 to 18 carbon atoms.

E.g. tetradecylbetaine, hexadecylbetaine, octadecylbetaine.

(2-2) Alkylimidazoline type amphoteric surfactants (a) N-Carboxymethyl-2-alkylimidazoline betaines, the alkyl moiety containing generally 8 to 24 carbon atoms, preferably 12 to 18 carbon atoms.

E.g. N-carboxymethyl-2-dodecylimidazoline betaine, N-carboxymethyl-2-tetradecylimidazoline betaine, N-carboxymethyl-2-hexadecylimidazoline betaine, N-carboxymethyl-2-octadecylimidazoline betaine.

(b) N-Aminoethyl-2-alkylimidazoline fatty acid salts, the alkyl moiety containing generally 8 to 24 carbon atoms, preferably 12 to 18 carbon atoms.

E.g. N-aminoethyl-2-tridecylimidazoline stearate, N-aminoethyl-2-pentadecylimidazoline oleate, N-aminoethyl-2-heptadecylimidazoline stearate.

(AM-2) Sulfonic acid salt type amphoteric surfactants (1) Betaine type

N-Alkyltaurine salts, the alkyl moiety containing generally 8 to 24 carbon atoms, preferably 12 to 18 carbon atoms.

E.g. sodium salt of N-stearyltaurine, sodium salt of N-lauryltaurine.

Preferred among the amphoteric surfactants mentioned under [AM] are carboxylate salt type amphoteric surfactants.

The above-mentioned surfactants may be used either alone or in combination. Thus, for example, a combination of (N-1) with other surfactants, {(N-2), (N-3), [AM] and/or [A] or [C]}, [the weight ratio of (N-1) to the other surfactants being generally 10:90 to 100:0, preferably 50:50 to 90:10]; a combination of (N-2) or (N-3) with ionic surfactants {[AM] and/or [A] or [C]}, [the weight ratio of (N-2) or (N-3) to the ionic surfactants being generally 10:90 to 100:0, preferably 50:50 to 90:10]; a combination of [A] with [AM], [the weight ratio of [A] to [AM] being generally 10:90 to 100:0, preferably 50:50 to 90:10], and a combination of [C] with [AM], [the weight ratio of [C] to [AM] being 10:90 to 100:0, preferably 50:50 to 90:10].

Preferred among the surfactants are as follows:

I. Alkylolamide type surfactants (N-1) and a combination of (N-1) with other surfactants {(N-2), (N-3), [AM] and/or [A] or [B]}.

II. Polyoxyalkylene type nonionic surfactants (N-2) and a combination of (N-2) with ionic surfactants }[AM] and/or [A] or [B]}.

III. Anionic surfactants [A] and a combination of [A] with amphoteric surfactants [AM] and IV. Cationic surfactants [C] and a combination of [C] with [AM].

Most preferred are alkylolamide type nonionic surfactants (N-1) and a combination of (N -1) with other surfactants.

In this invention, nonionic and anionic surfactants are preferable from the view point of the ash removal and agglomeration of the coal, and cationic surfactants are preferable from the view point of the agglomeration of the coal.

In practicing the invention, an inorganic electrolyte may be used, if necessary. Usable electrolytes are those alkali or alkaline earth metal salts that can be dissociated in water or aqueous media to release phosphate, sulfate, nitrate or chloride ions.

The salts dissociable to release phosphate ions include $NaH_2PO_4$, $Na_2HPO_4$, $Na_3PO_4$, $KH_2PO_4$, $K_2HPO_4$ and $K_3PO_4$. The salts dissociable to release sulfate ions include $NaHSO_4$, $Na_2SO_4$, $KHSO_4$ and $K_2SO_4$. The salts dissociable to release the nitrate ion include $NaNO_3$, $KNO_3$, $Ca(NO_3)_2$ and $Ba(NO_3)_2$. The salts dissociable to release the chloride ion include NaCl, $CaCl_2$ and $BaCl_2$. The above-mentioned compounds may contain water of crystallization.

Preferred inorganic electrolytes are those alkali metal salts dissociable to release phosphate and/or sulfate ions.

The coal which can be treated in the form of fine particles by the process of the invention includes lignite, brown coal, subbituminous coal, bituminous coal and anthracite. From the viewpoint of ash removal, the process is most effective with subbituminous coal and bituminous coal which are generally regarded as being rich in ash. Generally, the coal particles should have a maximum diameter or grain size of not greater than 3 mm (usually not greater than 1 mm). However, the smaller the coal particles are, the higher the efficiency of ash removal is. Therefore, the coal particles should preferably have such grain sizes that 100% of the particles can pass through a 60-mesh (Tyler) sieve. More preferably, the grain sizes are such that more than 70% of the particles can pass through a 200-mesh sieve.

No particular limitations are placed on the kinds of oil fractions to be added as binders to the aqueous slurry in the practice of the invention, provided that they are organic liquids which are immiscible with water. Generally, such usable oil fractions have a boiling point above 100° C. and viscosity of 2 to 10,000 centipoises (20° C.).

The oil fractions include such hydrocarbons as crude oils, heavy oils and kerosene; such halogenated hydrocarbons as perfluoroethylene; such nitro-substituted hydrocarbons as nitro-benzene; such amines as triamylamine; such alcohols as methylamyl alcohol; such ketones as methyl isobutyl ketone; such esters as propyl acetate and dioctyl phthalate; such fatty acids as oleic acid; and such animal and vegetable oils as whale oil and castor oil.

Among these oils, hydrocarbons such as crude oils, heavy oils and kerosene, alcohols such as methylamyl alcohol and animal and vegetable oils such as whale oil and castor oil are preferred from the viewpoints of safety, environmental pollution and economy.

The concentration of coal particles in the aqueous slurry thereof is generally not more than 50%, preferably in the range of 5 to 30%, based on the total weight of water plus coal particles. At higher slurry concentrations, larger amounts of coal may be treted, but a longer period of time is required for the agglomeration, leading to increase in the cost of treatment, especially when the concentration exceeds 50%.

The aqueous slurry of coal particles can be prepared either by dry pulverization of coal followed by throwing the pulverized mass into water or by wet pulverization of coal to form a slurry.

The level of addition of the surfactant in the aqueous slurry of coal particles is generally 10 to 2,000 ppm, preferably 20 to 300 ppm, based on the weight of coal (coal weight before the ash removal—The same shall apply hereinafter.). At surfactant levels of less than 10 ppm, the effect will be not sufficient, whereas levels exceeding 2,000 ppm will result in an increase in the cost of the process or sometimes effect.

The level of addition of the surfactant in the slurry is generally 0.5 to 1,000 ppm, preferably 1 to 90 ppm.

The amount of the electrolyte optionally contained in the aqueous slurry should be such that it does not lessen the effect of the surfactant. It is generally not more than 1%, preferably in the range of 0.5 to 1%, based on the weight of coal. If based on the aqueous slurry, it is generally not more than 0.5%, preferably 0.025 to 0.3%.

The weight ratio of the inorganic electrolyte to the surfactant is generally 100:0.5 to 100:20.

The amount of the oil fraction added as a binder is generally 2 to 30%, preferably 5 to 15%, based on the weight of coal. If the amount of the oil fraction is less than 2%, a prolonged period of time will be required for agglomeration. Conversely, if the amount exceeds 30%, the process will become uneconomical.

The aqueous slurry of coal particles which contains the surfactant and optionally the inorganic electrolyte can be prepared by charging a preparation vessel with coal (lumps or particles), surfactant (and if necessary inorganic electrolyte) and water in an arbitrary order, as far as the surfactant is added before addition of oil fraction. More particularly, such methods can be employed as the one comprising adding a surfactant to water, throwing coal into the resulting dispersion, grinding the coal when it is in the form of lumps, and agitating the mixture and the one comprising charging a vessel with coal and water, grinding the coal when it is in the form of lumps, and adding a surfactant to the mixture. Removal of ashes from coal starts at this very stage of slurry preparation. The electrolyte, when used, can be added in the same manner as in the case of the surfactant. The surfactant and the electrolyte may be added either separately or in the form of a mixture of both prepared beforehand.

It is essential in this invention to add an oil fraction to the aqueous slurry of coal particles which contains the surfactant and optionally the inorganic electrolyte. If the oil fraction is added to the aqueous slurry of coal particles which contains no surfactant, the good effects of ash removal cannot be obtained. The oil fraction per se may preferably be added to the aqueous slurry. The oil fraction may also be added in the form of an aqueous emulsion. The oil fraction may be added either all at once or in portions.

Agitation following the charging causes agglomeration of coal particles. The agitation is generally conducted at a speed of 300 to 1,500 rpm (revolutions per minute). If the speed is less than 300 rpm, a prolonged period of time is required for the agglomeration, and conversely, if the speed exceeds 1,500 rpm, not only will much more energy be required without any appreciable improvement in agglomeration effect but also the agglomerates once formed may be broken. At the abovementioned speed of agitation, the periferal velocity generally reaches 1 to 10 meters per second.

The agglomeration temperature may be varied in an adequate manner depending upon the properties of the oil fraction used as a binder. Preferred temperatures are such that the viscosity of the oil fraction at those temperatures is 5 to 1,000 centipoises. For example, in the case of oil fractions having low viscosity at ordinary temperatures, such as kerosene, better effects are produced at lower temperatures (e.g. 10° C. or below). Conversely, in the case of oil fractions having high viscosity at ordinary temperatures, such as Class C heavy oil, temperatures higher than room temperature (e.g. 30° C. or above) give better effects.

The agitation time may be varied depending upon several factors, such as kind of coal (especially ash content), agitation speed, amount of oil fraction and agglomeration temperature. Generally, however, the agitation time is 5 to 30 minutes, preferably 5 to 15 minutes.

The resulting agglomerates generally have diameters of 0.2 to 5 mm, preferably 0.5 to 5 mm, and can be recovered in an adequate manner, for example, by sifting the agglomeration mixture with a vibrating sieve, thereby leaving the agglomerates on the sieve and allowing the remainder slurry (containing unagglomerated particles and ashes) to pass through the sieve, whereby the ash is separated from the agglomerates. The agglomerates can be dehydrated, if necessary, by using a centrifuge or by drying, for instance. Further, if necessary, the remainder slurry which has passed through the sieve and contains unagglomerated particles and ash may again be subjected to the process of the invention. In this case, the process can also be conducted in a continuous or recycling manner.

The ash removal from and agglomeration of coal particles which comprises preparing the aqueous slurry, adding the oil fraction and agitating the mixture may be carried out either batchwise or continuously. The ash removal and agglomeration should preferably be conducted using suitable equipment, such as a vertical or horizontal type vessel. More specifically, the agglomeration vessel as disclosed in U.S. Pat. No. 4,153,419 may be used, and further such apparatus as an SPS (Shell Pelletizing Separator) test apparatus for batch processing, an SPS test apparatus for continuous procesing and a Giken-Sanyo's vertical type laboratory agglomerator, for instance, may also be used.

In accordance with the invention, ash removal can be realized to a satisfactory extent by adding a surfactant and optionally an inorganic electrolyte to a coal slurry and then adding an oil fraction, and agglomerates can be obtained at low costs, namely with a smaller amount of oil fraction and less energy for agglomeration. Since the agglomerates formed by the process of the invention have greater diameters, the amount of water adhering to the agglomerates is smaller, hence, when the agglomerates are dehydrated, the dehydration cost is reduced. Especially when the surfactant and the electrolyte are used in combination, the effects of ash removal, agglomeration and reduction in amount of adhering components are improved.

Furthermore, in accordance with the invention, an improved work efficiency is obtained because there is no necessity for preliminarily preparing an emulsion of the oil fraction to be added or for taking the trouble to repeat the treatment at least two times.

Having generally described the invention, a more complete understanding can be obtained by reference to certain specific examples, which are included for purposes of illustration only and are not intended to be limiting unless otherwise specified. In the examples, % designate % by weight.

EXAMPLE 1

The characteristics of the coal and oil fraction used in this example are shown in Table 1 and Table 2, respectively.

TABLE 1

| Coal Species | Bituminous coal I |
|---|---|
| Technical analysis | |
| Inherent moisture (%) | 2.2 |
| Ash content (%) | 30.6 |
| Volatile matter (%) | 32.5 |
| Fixed carbon (%) | 34.7 |
| Elemental analysis | |
| Carbon (%) | 56.6 |
| Hydrogen (%) | 4.4 |
| Oxygen (%) | 6.1 |
| Calorific value (kcal/kg) | 5610 |
| Grain size (200-mesh pass) (%) | 74.8 |

TABLE 2

| | Class C heavy oil (Correspond to A.S.T.M No.6) |
|---|---|
| Specific gravity (15/4° C.) | 0.981 |
| Viscosity (25° C., cps) | 1100 |

The following alkylolamide type nonionic surfactants (a-1) to (a-4) and the following anionic surfactant (a-5) were used as the additives in the practice of the invention:

(a-1) Stearic acid diethanolamide (1:1)

(a-2) Stearic acid dipropanolamide (1:1)

(a-3) Coconut oil fatty acid monoethanolamide (1:2)

(a-4) Mixture of 8 parts of stearic acid monoethanolamide (1:1) and 2 parts of sodium salt of nonylphenol-EO(4) sulfate (a-5) Sodium dodecylbenzenesulfonate Using the additives (a-1) to (a-5), test treatments of the coal for ash removal and agglomeration of coal particles were carried out in the following manner.

To 800 ml of tap water, there was added 20 ml of a 0.1% solution of each additive in water or a mixture of water and isopropyl alcohol, and the mixture was homogenized. Then, 200 g of bituminous coal I was added to prepare an aqueous slurry. To this aqueous slurry was added 30 g of Class C heavy oil, and the mixture was agitated with a three-vaned agitator at an agglomeration temperature of 30° C. for 15 minutes. The agitation speed was 1,200 rpm.

The product was sifted with a 250-micron sieve to separate the agglomerates from water which contained ashes as a dispersed phase. A blank test was done as a comparative example, wherein no surfactant was added. The results are shown in Table 3.

TABLE 3

| | (a-1) | (a-2) | (a-3) | (a-4) | (a-5) | blank |
|---|---|---|---|---|---|---|
| Coal recovery (%) | 91 | 88 | 90 | 96 | 76 | 0 |
| Ash removal (%) | 67 | 59 | 63 | 71 | 28 | 0 |
| Average grain size of the agglomerates (mm) | 1.8 | 1.7 | 1.9 | 2.4 | 0.8 | <0.25 |
| Water adhering to the agglomerates (%) | 16 | 16 | 15 | 14 | 29 | Could not be determined. |

EXAMPLE 2

The characteristics of the coal used in this example are shown in Table 4.

TABLE 4

| Coal species | Bituminous coal II |
|---|---|
| Technical analysis | |
| Inherent moisture (%) | 1.7 |
| Ash content (%) | 28.3 |
| Volatile matter (%) | 31.5 |
| Fixed carbon (%) | 38.5 |
| Elemental analysis | |
| Carbon (%) | 54.7 |
| Hydrogen (%) | 3.8 |
| Oxygen (%) | 5.9 |
| Calorific value (kcal/kg) | 5,730 |
| Grain size (200-mesh pass) (%) | 75.4 |

The following nonionic surfactants (b-1) to (b-4) and the following anionic surfactant (b-5) were used as the additives in practicing the invention:

(b-1) Polyoxyethylenestearylamine (the number of moles of EO added being 3.5)

(b-2) Polyoxyethylene glycol distearate ester (the number of moles of EO added being 14)

(b-3) Polyoxyethylene polyoxypropylene glycol (EO:PO=9:1, MW=1,400)

(b-4) Mixture of 9 parts of polyoxyethylenestearylamine (the number of moles of EO added being 3.5) and 1 part of lauryltrimethylammonium chloride (b-5) Sodium laurate Using the additives (b-1) to (b-5), test treatments of the coal for ash removal and agglomeration of coal particles were carried out in the following manner.

To 800 ml of tap water, there was added 20 ml of a 0.1% solution of each additive in water or a mixture of water and isopropyl alcohol (IPA), and the mixture was homogenized. Then, 200 g of bituminous coal II was added to prepare an aqueous slurry. The slurry was treated by the procedure of Example 1. The results are shown in Table 5.

TABLE 5

| | (b-1) | (b-2) | (b-3) | (b-4) | (b-5) | Blank |
|---|---|---|---|---|---|---|
| Coal recovery (%) | 87 | 84 | 82 | 96 | 74 | 0 |
| Ash removal (%) | 51 | 48 | 43 | 61 | 23 | 0 |
| Average grain size of the agglomerates (mm) | 1.6 | 1.6 | 1.4 | 2.3 | 0.6 | <0.25 |
| Water adhering to the agglomerates (%) | 17 | 18 | 18 | 14 | 34 | Could not be determined. |

EXAMPLE 3

The characteristics of the coal used in this example are shown in Table 6.

TABLE 6

| Coal species | Bituminous coal III |
|---|---|
| Technical analysis | |
| Inherent moisture (%) | 1.8 |
| Ash content (%) | 36.7 |
| Volatile matter (%) | 31.8 |
| Fixed carbon (%) | 29.7 |
| Elemental analysis | |
| Carbon (%) | 57.4 |
| Hydrogen (%) | 4.3 |
| Oxygen (%) | 5.9 |
| Calorific value (kcal/kg) | 5,470 |
| Grain size (200-mesh pass) (%) | 73.6 |

The following sulfate ester type anionic surfactants (c-1) to (c-4) and the following cationic surfactant (c-5) were used as the additives in accordance with the invention:

(c-1) Sodium salt of stearyl sulfate ester (c-2) Sodium salt of polyoxyethylenelauryl sulfate ester (the number of moles of EO added being 20)

(c-3) Sodium salt of polyoxyethylene nonylphenyl ether sulfate ester (the number of moles of EO added being 4)

(c-4) Mixture of 8 parts of sodium salt of polyoxyethylene nonylphenyl ether sulfate ester (the number of moles of EO added being 4) and 2 parts of N-stearyl-N, N-dimethyl-N-carboxymethylbetaine (c-5) Distearyldimethylammonium chloride Using the additives (c-1) to (c-5), test treatments of the coal for ash removal and agglomeration of coal particles were carried out in the following manner.

To 800 ml of tap water, there was added 20 ml of a 0.1% solution of each surfactant in water or a mixture of water and IPA, and the mixture was homogenized. Then, 200 g of bituminous coal III was added to prepare an aqueous slurry. The slurry was treated by the procedure of Example 1. The results are shown in Table 7.

TABLE 7

| | (c-1) | (c-2) | (c-3) | (c-4) | (c-5) | Blank |
|---|---|---|---|---|---|---|
| Coal recovery (%) | 81 | 84 | 94 | 95 | 89 | 0 |
| Ash removal (%) | 36 | 38 | 42 | 54 | 11 | 0 |
| Average grain size of the agglomerates (mm) | 1.2 | 1.4 | 1.3 | 1.8 | 2.0 | <0.25 |
| Water adhering to the agglomerates (%) | 22 | 19 | 20 | 16 | 15 | Could not be determined. |

EXAMPLE 4

The characteristics of the coal used in this example are shown in Table 8.

TABLE 8

| Coal species | Bituminous coal IV |
|---|---|
| Technical analysis | |
| Inherent moisture (%) | 12.6 |
| Ash content (%) | 24.6 |
| Volatile matter (%) | 38.6 |
| Fixed carbon (%) | 24.2 |
| Elemental analysis | |
| Carbon (%) | 54.7 |
| Hydrogen (%) | 4.8 |
| Oxygen (%) | 5.4 |
| Calorific value (kcal/kg) | 5,670 |
| Grain size (200-mesh pass) (%) | 76.8 |

The following anionic surfactants (d-1) to (d-4) and the following cationic surfactant (d-5) were used as the additives in accordance with the invention:

(d-1) Sodium laurate (d-2) Sodium salt of polyoxyethylene nonylphenyl ether phosphate ester (the number of moles of EO added being 5.5)

(d-3) Sodium laurylbenzenesulfonate (d-4) Mixture of 9 parts of sodium salt of polyoxyethylene nonylphenyl ether phosphate ester (the number of moles of EO added being 5.5) and 1 part of N-stearyl-N, N-dimethyl-N-carboxymethylbetaine (d-5) Distearyldimethylammonium chloride Using the additives (d-1) to (d-5), test treatments of the coal for ash removal and agglomeration of coal particles were carried out in the following manner.

To 800 ml of tap water was added 20 ml of a 0.1% solution of each additive in water or a mixture of water and IPA, and the mixture was homogenized. Then, 200 g of bituminous coal IV was added to prepare an aqueous slurry, The slurry was treated by the procedure of Example 1. The results are shown in Table 9.

TABLE 9

| | (d-1) | (d-2) | (d-3) | (d-4) | (d-5) | Blank |
|---|---|---|---|---|---|---|
| Coal recovery (%) | 74 | 88 | 76 | 94 | 89 | 0 |
| Ash removal (%) | 28 | 36 | 28 | 43 | 11 | 0 |
| Average grain size of the agglomerates (mm) | 0.6 | 1.1 | 0.8 | 1.2 | 2.0 | <0.25 |
| Water adhering to the agglomerates (%) | 34 | 24 | 29 | 21 | 15 | Could not be determined. |

EXAMPLE 5

The characteristics of the coal used in this example are shown in Table 10.

TABLE 10

| Coal species | Bituminous coal V |
|---|---|
| Technical analysis | |
| Inherent moisture (%) | 2.0 |
| Ash content (%) | 31.6 |
| Volatile matter (%) | 31.8 |
| Fixed carbon (%) | 34.6 |
| Elemental analysis | |
| Carbon (%) | 57.8 |
| Hydrogen (%) | 4.1 |
| Oxygen (%) | 61.8 |
| Calorific value (kcal/kg) | 5,721 |
| Grain size (200-mesh pass) (%) | 73.8 |

The following amphoteric surfactants (e-1) to (e-3) and the following cationic surfactant (e-4) were used as the additives in accordance with the invention:

(e-1) Sodium salt of octyldi(aminoethyl)glycine (e-2) N-stearyl-N, N-dimethyl-N-carboxymethylbetaine (e-3) Mixture of 7 parts of N-stearyl-N, N-dimethyl-N-carboxymethylbetaine and 3 parts of stearyldimethylbenzylammonium chloride (e-4) Distearyldimethylammonium chloride Using the additives (e-1) to (e-4), test treatments of the coal for ash removal and agglomeration of coal particles were carried out in the following manner.

To 800 ml of tap water was added 20 ml of a 0.1% solution of each additive in water or a mixture of water and isopropyl alcohol, and the mixture was homogenized. Then, 200 g of bituminous coal V was added to prepare an aqueous slurry. The slurry was treated by the procedure of Example 1. The results are shown in Table 11.

TABLE 11

| | (e-1) | (e-2) | (e-3) | (e-4) | Blank |
|---|---|---|---|---|---|
| Coal recovery (%) | 93 | 92 | 93 | 89 | 0 |
| Ash removal (%) | 11 | 13 | 13 | 11 | 0 |
| Average grain size of the agglomerates (mm) | 2.0 | 2.2 | 2.3 | 2.5 | <0.25 mm |
| Water adhering to the agglomerates (%) | 15 | 19 | 19 | 10 | Could not be determined. |

EXAMPLE 6

The characteristics of the coal used in this example are shown in Table 12.

TABLE 12

| Coal species | Bituminous coal VI |
|---|---|
| Technical analysis | |
| Inherent moisture (%) | 2.3 |
| Ash content (%) | 30.8 |
| Volatile matter (%) | 32.4 |
| Fixed carbon (%) | 34.5 |
| Elemental analysis | |
| Carbon (%) | 56.3 |
| Hydrogen (%) | 4.4 |
| Oxygen (%) | 6.0 |
| Calorific value (kcal/kg) | 5,630 |
| Grain size (200-mesh pass) (%) | 74.7 |

The following cationic surfactants (f-1) and (f-2) and the following anionic surfactant (f-3) were used as the additives in accordance with the invention:

(f-1) Stearyldimethylbenzylammonium chloride (f-2) Distearyldimethylammonium chloride (f-3) Stearic acid ethanolamine ester hydrochloride Using the additives (f-1) to (f-3), test treatments of the coal for ash removal and agglomeration of coal particles were carried out in the following manner.

To 800 ml of tap water was added 20 ml of a 0.1% solution of each additive in water or a mixture of water and isopropyl alcohol, and the mixture was homogenized. Then, 200 g of bituminous coal VI was added to prepare an aqueous slurry. The slurry was treated by the procedure of Example 1. The results obtained are shown in Table 13.

TABLE 13

| | (f-1) | (f-2) | (f-3) | Blank |
|---|---|---|---|---|
| Coal recovery (%) | 91 | 89 | 93 | 0 |
| Ash removal (%) | 7 | 11 | 9 | 0 |

TABLE 13-continued

| | (f-1) | (f-2) | (f-3) | Blank |
|---|---|---|---|---|
| Average grain size of the agglomerates (mm) | 2.1 | 2.0 | 2.1 | <0.25 |
| Water adhering to the agglomerates (%) | 15 | 15 | 16 | Could not be determined. |

EXAMPLE 7

The characteristics of the coals and oil fractions used in Examples 7 to 9 are shown in Table 14 and Table 15.

TABLE 14

| | Coals | | |
|---|---|---|---|
| | Bituminous coal | | Subbituminous coal |
| | VII | VIII | I |
| Technical analysis | | | |
| Inherent moisture (%) | 1.7 | 2.8 | 15.1 |
| Ash content (%) | 32.4 | 9.2 | 9.3 |
| Volatile matter (%) | 29.8 | 41.7 | 44.2 |
| Fixed carbon (%) | 36.1 | 46.3 | 31.4 |
| Elemental analysis | | | |
| Carbon (%) | 82.8 | 80.4 | 61.9 |
| Hydrogen (%) | 6.3 | 6.2 | 4.9 |
| Oxygen (%) | 8.4 | 11.9 | 21.6 |
| Calorific value (kcal/kg) | 5,500 | 7,130 | 5,070 |
| Grain size (200-mesh pass) (%) | 78.2 | 76.5 | 50.3 |

TABLE 15

| | Oil fractions | | |
|---|---|---|---|
| | Class C heavy oil | Kerosene | Methylamyl alcohol |
| Specific gravity (15/4° C.) | 0.981 | 0.789 | 0.808(20° C.) |
| Viscosity (25° C., cps) | 1,100 | 2 | 5(20° C.) |

In a one-liter agitation vessel equipped with 3 four-vaned agitating rods, there were placed 900 ml of tap water, 10 ml of a 0.1% solution of stearic acid monoethanolamide in a mixture of water and isopropyl alcohol and 2 g of disodium hydrogenphosphate ($Na_2HPO_4$), and the mixture was homogenized. Then, 100 g of bituminous coal VII was added to prepare an aqeuous slurry.

To this slurry was added 15 g of Class C heavy oil, and the mixture was agitated at an agitation speed of 1,500 rpm at 30° C. for 15 minutes. The product mixture was sifted with a 250-micron sieve to give the agglomerates on one hand and an aqueous phase containing ashes dispersed therein, on the other. The agglomerates were not subjected to any particular dehydration process. A test was also done wherein only the surfactant was added and the addition of the inorganic electrolyte was omitted, and further a blank test was done wherein neither of the surfactant and inorganic electrolyte was added. The results obtained are shown in Table 16.

TABLE 16

| | Surfactant and inorganic electrolyte added | Surfactant alone added | Blank |
|---|---|---|---|
| Coal recovery (%) | 90 | 87 | 0 |
| Ash removal (%) | 63 | 26 | 0 |
| Average grain size of the agglomerates (mm) | 1.8 | 1.6 | 250 microns |
| Water adhering to the agglomerates (%) | 17 | 26 | Could not be determined. |

TABLE 16-continued

EXAMPLE 8

15 ml of a 0.1% aqueous solution of sodium salt of polyoxyethylene (4 moles), nonylphenyl ether sulfate ester and 300 g of bituminous coal VIII were added to 700 ml of tap water in the same agglomeration vessel as in Example 7, to prepare an aqueous slurry.

Kerosene (30 g) was added as an oil fraction to the aqueous slurry, and the resulting mixture was agitated at an agitation speed of 1,200 rpm at an agglomeration temperature of 5° C. for 15 minutes. The product mixture was treated in the same manner as in Example 7. A blank test was also done. The results obtained are shown in Table 17.

TABLE 17

| | Surfactant added | Blank |
|---|---|---|
| Coal recovery (%) | 93 | 83 |
| Ash removal (%) | 25 | 11 |
| Average grain size of the agglomerates (mm) | 1.9 | 0.4 |
| Water adhering to the agglomerates (%) | 17 | 55 |

EXAMPLE 9

10 ml of a 0.1% solution of distearyldimethylammonium chloride in a mixture of water and IPA was added to 800 ml of tap water in the same agglomeration vessel as in Example 7, and the mixture was homogenized. Then, 200 g of subbituminous coal I was added to prepare an aqueous slurry.

30 g of methylamyl alcohol was added as an oil fraction to the aqueous slurry, and the mixture was agitated at an agitation speed of 1,000 rpm at an agglomeration temperature of 15° C. for 15 minutes. A blank test was also done in the same manner. The results obtained are shown in Table 18.

TABLE 18

| | Surfactant added | Blank |
|---|---|---|
| Coal recovery (%) | 92 | 68 |
| Ash removal (%) | 34 | 12 |
| Average grain size of the agglomerates (mm) | 2.3 | 0.3 |
| Water adhering to the agglomerates (%) | 16 | 58 |

EXAMPLE 10

To 700 ml of tap water was added 30 ml of a 0.1% aqueous solution of a mixture of 7 parts of stearic acid monoethanolamide and 3 parts of distearyldimethylammonium chloride in a mixture of water and IPA, and the mixture was homogenized. Then, 300 g of bituminous coal VII was added to prepare an aqueous slurry. To this slurry was added as an oil fraction 30 g of Class C heavy oil, and the mixture was agitated at an agitation speed of 1,500 rpm at an agglomeration temperature of 30° C. for 15 minutes. The product mixture was treated in the same manner as in Example 7. A blank test was also carried out in the same manner. The results obtained are shown in Table 19.

TABLE 19

| | Surfactant added | Blank |
|---|---|---|
| Coal recovery (%) | 95 | 0 |
| Ash removal (%) | 64 | 0 |
| Average grain size of the agglomerates (mm) | 2.1 | <0.25 |
| Water adhering to the agglomerates (%) | 17 | Could not be determined. |

What is claimed as new and intended to be covered by Letters Patent is:

1. A process for treating coal particles for ash removal therefrom as well as agglomeration thereof, which comprises adding an oil fraction as a binder to an aqueous slurry of coal particles which contains a sufficient amount of at least one surfactant to cause ash removal and agglomeration of coal particles, and agitating the mixture to effect the ash removal and agglomeration of the coal particles.

2. The process of claim 1, wherein the surfactant is an alkylolamide type surfactant or a combination thereof with an other surfactant.

3. The process of claim 2, wherein the alkylolamide type surfactant is a compound represented by the general formula

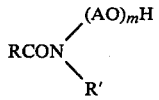

(1)

wherein R is an acyl group residue containing 5 to 24 carbon atoms, A is an alkylene group containing 2 to 4 carbon atoms, R' is (—AO)nH or hydrocarbon group, m is an integer of at least 1, n is 0 (zero) or an integer of at least 1, and m+n is equal to 1 to 100.

4. The process of claim 1, wherein the surfactant is a nonionic surfactant other than the alkylolamide type surfactant or a combination of said nonionic surfactant with an ionic surfactant.

5. The process of claim 4, wherein said nonionic surfactant is a polyoxyethylene type nonionic surfactant.

6. The process of claim 3, wherein said nonionic surfactant is at least one nonionic surfactant selected from the group consisting of a polyoxyalkylene polyhydric alcohol fatty acid ester, a polyoxyalkylene fatty acid ester and a polyoxyalkylene alkylamine.

7. The process of claim 1, wherein the surfactant is an anionic surfactant or a combination thereof with an amphoteric surfactant.

8. The process of claim 7, wherein the anionic surfactant is a sulfate ester salt, a carboxylic acid salt, a sulfonic acid salt or a phosphate ester salt.

9. The process of claim 7, wherein the anionic surfactant is a sulfate ester salt.

10. The process of claim 1, wherein the surfactant is a cationic surfactant or a combination thereof with an amphoteric surfactant.

11. The process of claim 10, wherein the cationic surfactant is a quaternary ammonium salt or an amine salt.

12. The process of claim 1, wherein the slurry contains the surfactant in an amount of 10 to 2,000 ppm based on the weight of the coal.

13. The process of claim 1, wherein the oil fraction is added in an amount of 2 to 30% based on the weight of the coal.

14. The process of claim 1, wherein the oil fraction is an organic liquid immiscible with water.

15. The process of claim 14, wherein the organic liquid is selected from the group consisting of hydrocarbon oils, alcohols, animal oils and vegetable oils.

16. The process of claim 1, wherein the oil fraction has a viscosity of 2 to 10,000 centipoises (20° C.).

17. The process of claim 1, wherein the coal is lignite, brown coal, subbituminous coal, bituminous coal or anthracite.

18. The process of claim 1, wherein the coal is subbituminous coal or bituminous coal.

19. The process of claim 1, wherein the coal particles have the maximum diameter or grain size of not greater than 3 mm.

20. The process of claim 1, wherein the concentration of coal particles in the aqueous slurry thereof is not more than 50% based on the total weight of water and coal particles.

21. The process of claim 1, wherein the resulting agglomerates have diameters of 0.2 to 5 mm.

22. A process for treating coal particles for ash removal therefrom as well as agglomeration thereof, which comprises adding an oil fraction as a binder to an aqueous slurry of coal particles which contains a sufficient amount of a surfactant and an inorganic electrolyte to cause ash removal and agglomeration of coal particles, and agitating the mixture to effect the ash removal and agglomeration of the coal particles.

23. The process of claim 22, wherein the inorganic electrolyte is selected from the group consisting of alkali and alkaline earth metal salts capable of releasing phosphate, sulfate, nitrate and chloride ions, respectively, in water.

24. The process of claim 22, wherein the inorganic electrolyte is alkali or alkaline earth metal salts capable of releasing phosphate or sulfate ions.

25. The process of claim 22, wherein the aqueous slurry of coal particles contains 0.5 to 1% of an inorganic electrolyte based on the weight of the coal.

26. The process of claim 22, wherein the slurry contains the surfactant in an amount of 10 to 2,000 ppm based on the weight of the coal.

27. The process of claim 22, wherein the weight ratio of the inorganic electrolyte to the surfactant is 100:0.5 to 100:20.

* * * * *